US006018163A

United States Patent [19]

Stephens et al.

[11] Patent Number: 6,018,163

[45] Date of Patent: Jan. 25, 2000

[54] LAB DEVICES TO SIMULATE INFRARED SCENES WITH HOT POINT TARGETS AGAINST GIVEN TEMPERATURE BACKGROUNDS

[76] Inventors: Clark A. Stephens, 4340 N. Ventana Loop, Tucson, Ariz. 85750; Jeff S. Wolske, 6281 N.Cinnamon Dr., Tucson, Ariz. 85741; Terry A. Sapp, 1080 S. Avenida Conalea, Tucson, Ariz. 85748

[21] Appl. No.: 09/054,724

[22] Filed: Apr. 3, 1998

[51] Int. Cl.[7] ..... H05B 3/10

[52] U.S. Cl. ..... 250/493.1; 250/494.1; 250/495.1; 250/504 R

[58] Field of Search ..... 250/493.1, 494.1, 250/495.1, 504 R; 219/552, 553

[56] References Cited

U.S. PATENT DOCUMENTS 5,479,025 12/1995 Huniu et al. ..... 250/504 R

*Primary Examiner*—Kiet T. Nguyen
*Attorney, Agent, or Firm*—Harness, Dickey & Pierce; Andrew J. Rudd; Glenn H. Lenzen, Jr.

[57] ABSTRACT

The present invention provides a missile seeker simulator (10) including a means for supplying a hot, point-like target against a given temperature background. The missile seeker simulator (10) includes a background source consisting of a hot cavity blackbody (56), fiber optic cable (64), silicon wafer (68), and controllable temperature source (76). The hot cavity blackbody target source (56) generates infrared radiation (58) in a wide bandpass. The fiber optic cable (64) receives and transmits the radiation (58) from the hot cavity blackbody (56). The silicon wafer (68) is remotely located from the hot cavity blackbody (56) and is positioned such that a pinhole (72) in the silicon wafer (68) is proximate a radiation emitting end (74) of the fiber optic cable (64). The silicon wafer (68) is also positioned in radiation receiving relation to the controllable temperature source (76). Collimating optics (80) receive the radiation (78, 58) from the controllable temperature source (76) and the fiber optic cable (64) via the silicon wafer (68) and pinhole (72) and presents it to the missile seeker (28). The fiber optic cable (64) facilitates remotely locating the hot cavity blackbody target source (56) from silicon wafer (68) to prevent any localized heating of the area presented as the background. The silicon wafer (68) provides the high spatial uniformity necessary for critical performance tests and the high temporal stability required for critical optical characterization tests. Optionally, the end (74) of the fiber optic cable (64) may be positioned at the focus of the collimating optics (80) while the silicon wafer (68) is positioned out-of-focus to yield a uniform background and a sharp point-like target appearing to originate at infinity. Advantageously, the silicon wafer (68) may consist of a low-cost "off-the-shelf" super-polished silicon wafer typical of those currently in wide use in the semiconductor industry.

23 Claims, 1 Drawing Sheet

LAB DEVICES TO SIMULATE INFRARED SCENES WITH HOT POINT TARGETS AGAINST GIVEN TEMPERATURE BACKGROUNDS

BACKGROUND OF THE INVENTION

1. Technical Field

The present invention generally relates to simulation devices for simulating combat-type scenarios to missile seekers and, more particularly, to a simulation device for simulating a far-away missile target against a sky-temperature background or a space-temperature background with a hot, point-like target against a given temperature background.

2. Discussion

As with other military devices, missile seeker systems and missile seeker operators require periodic testing and training. To accomplish this in the most economically feasible manner, simulation devices have been devised to replicate a scene typically encountered by the missile seeker and operator in real life circumstances. Commonly, the scene to be replicated includes a hot target, (e.g., a missile), against a given temperature background, (e.g., sky or space).

To present a realistic but simulated scene to the missile seeker, the simulator must present a hot, point-like target against a spatially uniform and temporally stable background. Conventional simulators typically utilize one of two types of background sources for this purpose, emissive-type or reflective-type. An emissive-type background source sits at room temperature and radiometrically emits a temperature that is exactly the same temperature as its ambient surroundings. As the temperature of the surroundings change, the temperature of the background source also changes. At times, this may cause an unwanted artifact when testing sensitive missile seeker detectors. A reflective type background source overcomes this problem by radiometrically reflecting the temperature of an external, controllable source. The controlled source is typically near ambient temperature, but does not fluctuate over time. The controllable source is commonly referred to as a plate or extended blackbody.

Prior art simulators employing emissive-type background sources replicate only cold, space-like backgrounds without a hot point-like target source. Adding a hot point source against the cold background is advantageous for simulating more realistic scenarios for the missile seeker. Prior art attempts to add a hot point source to the cold background have resulted in stray light noise within the simulation. Furthermore, illuminating a pinhole target etched on the surface of an emissive-type cold blackbody typically results in localized heating of the area presented as the cold background and distortion of the target.

Prior art simulators employing reflective-type backgrounds to replicate warmer, sky-like backgrounds, fail to supply a featureless and specular (i.e., "clean") background. Due to the poor surface quality of the polished metal substrates used to date, these backgrounds have poor uniformity and exhibit stray light noise. High spatial uniformity is necessary for critical missile seeker performance tests such as target-tracking and high temporal stability is important for critical optical characterization tests.

Therefore, it would be desirable to provide a missile seeker simulator for providing a hot, point-like target against an emissive-type background without localized heating of the background and without stray light noise. It would also be desirable for providing a missile seeker simulator for providing a hot, point-like target against a spatially uniform and temporally stable reflective-type background. It would also be desirable to provide a modular missile seeker simulator for use in field testing at remote locations.

SUMMARY OF THE INVENTION

The above and other objects are provided by a missile seeker target simulator including a means for supplying a hot, point-like target against a given temperature background. In one embodiment of the present invention, the missile seeker simulator includes a hot cavity blackbody target source for generating infrared radiation in a wide bandpass. A fiber optic cable is positioned in radiation receiving relation to the hot cavity blackbody target source for receiving and transmitting the infrared radiation generated therein. An emissive-type cold background source in the form of a tank filled with liquid nitrogen is remotely located from the hot cavity blackbody target source and is positioned proximate a radiation emitting end of the fiber optic cable. Collimating optics receive the radiation from the background source and the fiber optic cable and deliver it to a conventional missile seeker detector. As such, a hot, point-like target from the end of the fiberoptic cable is presented against a space-like background from the liquid nitrogen filled tank. The fiber optic cable facilitates remotely locating the hot cavity blackbody target source from the liquid nitrogen filled tank background source to prevent any localized heating of the area of the tank presented as the cold background. Preferably, the end of the fiber optic cable is located at the focus of the collimating optics and the background surface is positioned out-of-focus to yield a uniform presentation of the cold background and a sharp point-like target appearing to originate at infinity.

In a second embodiment of the present invention, the missile seeker simulator includes a reflective type background source including a super-polished silicon wafer located in radiation receiving relation to a controllable temperature source. The silicon wafer and controllable temperature source combine to form an extended blackbody for the simulator. A cavity blackbody target source is located proximate the silicon wafer for illuminating a pinhole formed therein with infrared radiation in a wide bandpass. Collimating optics receive the radiation from the silicon wafer and cavity blackbody target source (via the pinhole) and present it to the missile seeker detector. As such, a hot, point-like target is presented against a sky-like background from the silicon wafer. The silicon wafer provides the high spatial uniformity necessary for critical performance tests and the high temporal stability required for critical optical characterization tests. Advantageously, the silicon wafer may consist of a low-cost "off-the-shelf"super-polished silicon wafer typical of those currently in wide use in the semiconductor industry.

In a third embodiment of the present invention, the missile seeker simulator includes a background source consisting of a hot cavity blackbody, fiber optic cable, silicon wafer, and controllable temperature source. The hot cavity blackbody target source generates infrared radiation in a wide bandpass. The fiber optic cable receives and transmits the radiation from the hot cavity blackbody. The silicon wafer is remotely located from the hot cavity blackbody and is positioned such that a pinhole in the silicon wafer is proximate a radiation emitting end of the fiber optic cable. The silicon wafer is also positioned in radiation receiving relation to the controllable temperature source. Collimating optics receive the radiation from the controllable temperature source and the fiber optic cable via the silicon wafer and pinhole and present it to the missile seeker. The fiber optic cable facilitates remotely locating the hot cavity blackbody from the silicon wafer and the silicon wafer provides a clean, spatially uniform, and temporally stable background. Optionally, the end of the fiber optic cable may be positioned at the focus of the collimating optics while the silicon wafer is positioned out-of-focus to yield a uniform background and a sharp point-like target appearing to originate at infinity.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DESCRIPTION OF THE PREFERRED EMBODIMENTS

The present invention is directed towards lab devices for simulating faraway missile targets against sky and space backgrounds with hot, point-like targets against given temperature backgrounds. To accomplish this, emissive-type, spacelike background sources and reflective-type, sky-like background sources are provided. According to one aspect of the present invention, a fiber optic cable is employed to transmit infrared radiation from a remotely located hot blackbody target radiation source to a given temperature background source. The fiber optic cable ensures high contrast between the two temperature sources in the simulated scene, i.e., the hot cavity blackbody target source and the background source. According to another aspect of the present invention, a super-polished silicon substrate is utilized as a reflective surface for a background source to minimize noise and unwanted artifacts presented to the missile seeker as well as to ensure temporal stability.

Figure 1:
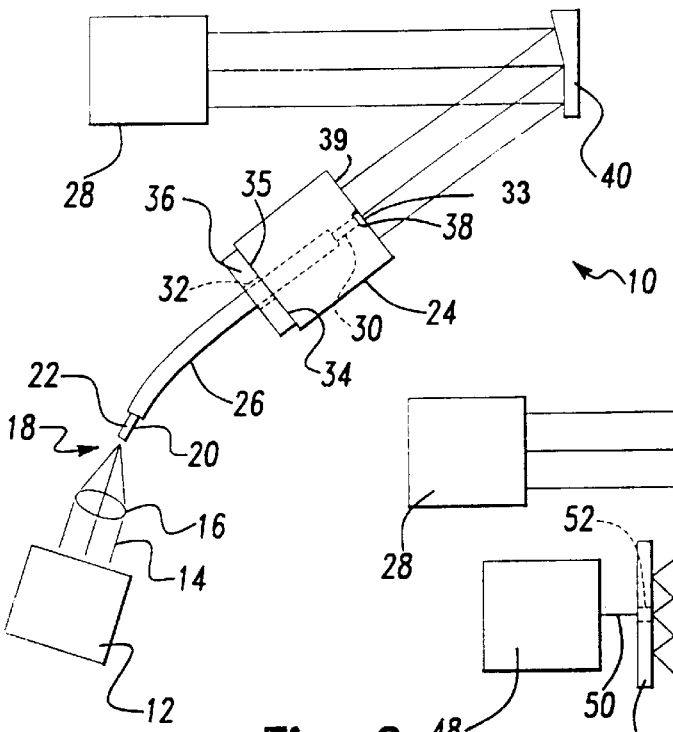
FIG. 1 is a schematic view of a first embodiment missile seeker simulator in accordance with the teachings of the present invention.

Turning now to the drawing figures, a first embodiment missile seeker simulator 10 is illustrated schematically in FIG. 1. The simulator 10 includes a hot cavity blackbody target radiation source 12 for producing infrared radiation in a known bandpass. The hot cavity blackbody 12 preferably consists of an Electro Optical Industries LS1050 Series Blackbody, and generates infrared radiation 14 in a wide band of wavelengths. The infrared radiation is emitted from the hot cavity blackbody 12 as a beam 14 directed towards condensing optics 16. Although the condensing optics 16 illustrated consists of a lens, the skilled artisan will appreciate that other optical devices such as multiple lenses, mirrors, and prisms could substitute therefore. The condensing optics 16 focus the radiation 14 to a focal point 18 one focal length from the condensing optics 16.

A fiber optic cable 20 is positioned in radiation receiving relation to the hot cavity blackbody 12. This is preferably accomplished by positioning a first end 22 of the fiber optic cable 20 at the focal point 18. At this point, the first end 22 receives the focused beam of radiation 14 from the hot cavity blackbody 12 via the condensing optics 16. Although various fiber optic cables are suitable for use herein, it is presently preferred to use a fiber optic cable P/N MIR200/300 manufactured by CeramOptic.

The fiber optic cable 20 extends away from the hot cavity blackbody 12 a pre-selected distance toward an emissive-type background source consisting of a liquid nitrogen filled tank 24. The span of the fiber optic cable 20 enables the hot cavity blackbody 12 to be remotely located in spaced relation to the tank 24. This prevents localized heating (and therefore contamination) of the portion of the tank 24 presented as the background source and preserves the integrity of the simulator 10. The preferred material for the tank 24 is stainless steel.

Preferably, the fiber optic cable 20 is encapsulated along its length with an insulating tube 26 such as a foam sleeve. The insulating tube 26 prevents the heat signature of the fiber optic cable 20 from being undesirably detected by the missile seeker detector 28. However, the second end 30 of the fiber optic cable 20, which is not covered with the insulating tube 26, is exposed to the missile seeker detector 28. As such, the second end 30 emits the radiation from the hot cavity blackbody 12 at a given location to simulate a point-like heat source.

The fiber optic cable 20 enters the tank 24 at the back wall 34 and is routed through the tank feedthrough or aperture 32 formed in the back wall 34 of the tank 24. The end 30 of the fiber optic cable 20 is positioned in aperture 33 slightly recessed behind, or protruding through aperture 33 slightly forward of, the front surface 39 of tank 24 to simulate a hot, point-like target located at infinity against a space-like, controlled temperature background. The front surface 39 serves as the emissive background surface and, therefore, is preferably sandblasted to a uniform finish and painted flat black for high emissivity.

The liquid nitrogen in the tank 24 controls the temperature of the emissive front surface 39 of the tank 24 Oto ensure that a temporally uniform background surface is provided. The tank 24 preferably includes a layer of insulation 36 adjacent to the rear surface of the back wall 34 and optionally the remaining non-emissive walls for added isolation from outside temperature influences.

The second end 30 of the fiber optic cable 20 is preferably positioned at the focus 38 of a collimating optical system 40 which receives the radiation from the front surface 39 and the end 30 of the fiber optic cable 20 and presents it to the missile seeker detector 28. To accomplish this, the second end 30 of the fiber optic cable 20 is positioned slightly out of the plane of emissive surface 39 thereby keeping the hot point target at the focus of the collimating system 40 while keeping the emissive, cold background surface 39 out of the focus position. In this way, a more uniform presentation of the cold background may be made to the missile seeker detector 28 while keeping the point target at a preselected position such that it appears sharp, and to originate at infinity.

Figure 2:
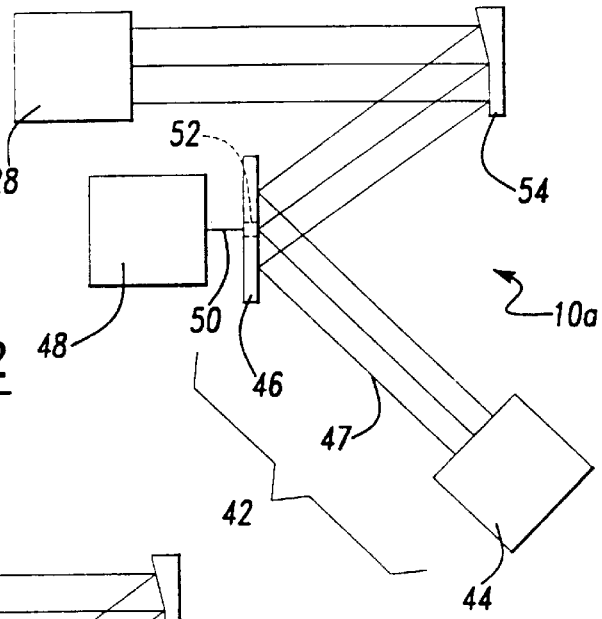
FIG. 2 is a schematic view of a second embodiment missile seeker simulator according to the present invention.

Turning now to FIG. 2, a second embodiment missile seeker simulator 10*a* is illustrated. In this embodiment, an extended reflective-type background source 42 consisting of a controlled temperature source 44 and a reflective silicon substrate 46 is provided. The temperature source 44 provides radiation 47 at a given temperature to the silicon substrate 46. As such, the silicon substrate 46 reflects at a preselected, controllable temperature which does not fluctuate with ambient conditions. It is presently preferred to use a Santa Barbara Infrared (SBIR) model 2008 Series as the controllable temperature source 44.

A cavity blackbody target radiation source 48 is disposed proximate the silicon substrate 46 for providing radiation in the form of a beam 50 in a known bandpass. The beam 50 is projected from the cavity blackbody source 48 such that it illuminates a pinhole 52 formed through the silicon substrate 46. In this way, a hot, point-like target is presented against a controlled temperature background source. The cavity blackbody 48 is preferably an Electro Optical Industries LS1050 Series Blackbody.

Preferably, the silicon substrate 46 is super-polished for providing a uniform and stable reflective background surface against which to present the point-like radiation from the cavity blackbody source 48. The super-polished surface of the silicon substrate 46 may be gold coated for high infrared reflectivity, and nearly eliminating artifacts presented to the missile seeker detector 28 due to surface defects. Advantageously, the silicon substrate 46 may consist of a low-cost "off-the-shelf" super-polished silicon wafer typical of those currently in wide use in the semiconductor industry which decreases cost and delivery time, while increasing performance. If desired, the silicon substrate 46 may be etched with super-fine detail to simulate complex geometries found in unusual targets. Although any sized silicon substrate 46 can be utilized herein, it is presently preferred to use six, eight, and twelve inch diameter silicon wafers, readily available in the semiconductor industry.

Collimating optics 54 are disposed in spaced relation to the silicon substrate 46 to receive the radiation from the temperature source 44 as reflected from the silicon substrate 46 and the radiation from the cavity blackbody 48 as emitted through the pinhole 52. The collimating optics present this, radiation to the missile seeker detector 28. As such, the missile seeker detector 28 is presented with a hot, point-like target against a reflective-type, sky-like background.

Figure 3:
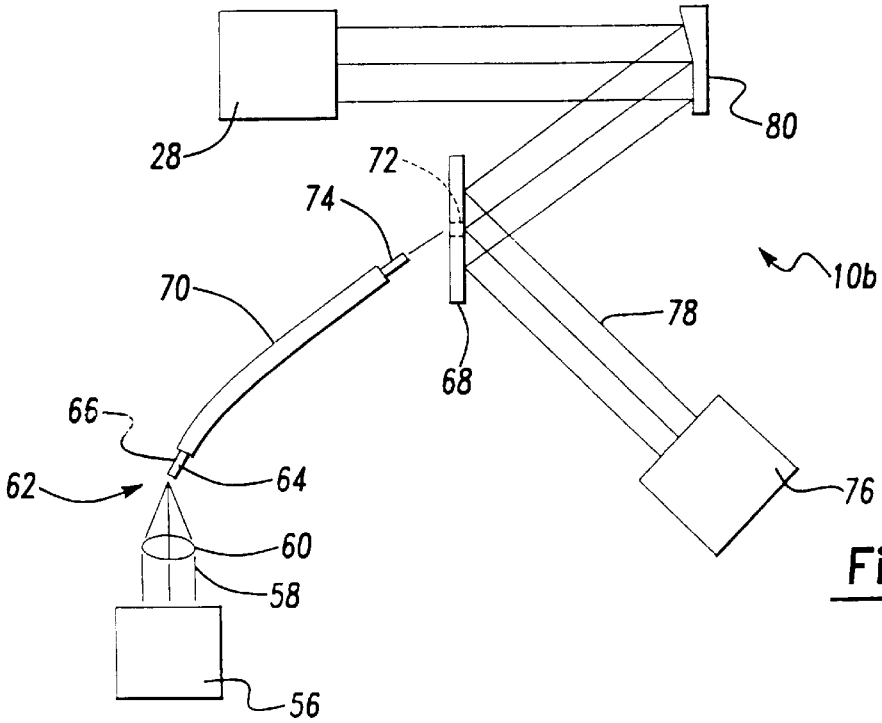
FIG. 3 is a schematic view of a third embodiment missile seeker simulator according to the present invention.

Turning now to FIG. 3, a third embodiment missile seeker simulator 10*b* is illustrated. In this embodiment, a cavity blackbody source 56 is provided for producing infrared radiation in a wide bandpass. The infrared radiation is emitted from the hot cavity blackbody 56 as a beam 58 directed towards condensing optics 60. The condensing optics 60 focus the radiation to a focal point 62 one focal length from the condensing optics 60.

A fiber optic cable 64 is positioned in radiation receiving relation to the hot cavity blackbody 56 by positioning a first end 66 of the fiber optic cable 64 at the focal point 62. The fiber optic cable 64 extends away from the hot cavity blackbody 56 a pre-selected distance towards a super-polished silicon wafer 68. Preferably, the fiber optic cable 64 is encapsulated along its length with an insulating tube 70 such as a foam sleeve to prevent the heat signature of the fiber optic cable 64 to be undesirably detected by the missile seeker 28. As with previous embodiments, it is preferred to use a fiberoptic cable P/N MIR 200/300 by CeramOptic in combination with an Electro Optical Industries LS1050 Blackbody.

The fiber optic cable 64 terminates at a location proximate a pin hole 72 formed in the silicon wafer 68. The second end 74 of the fiber optic cable 64, which is not covered with the insulating tube 70, is suspended in spaced relation adjacent the pinhole 72 to simulate a hot, point-like target against a controlled temperature background. If desired, the insulating tube 70 and fiber optic cable 64 may be passed through an aperture in the silicon wafer 68 such that the second end 74 of the fiber optic cable 64 is suspended in front of the surface of the silicon wafer 68 to simulate a hot point-like target located at infinity against a controlled temperature background.

The silicon substrate 68 is also disposed in spaced, radiation receiving relation to a controlled temperature source 76 such as an SBIR 2008 Series blackbody as above. The temperature source 76 provides radiation 78 at a given temperature to the silicon substrate 68. As such, the silicon substrate 68 reflects a pre-selected, controllable temperature which does not fluctuate with ambient conditions. The substrate 68 receives the radiation from the temperature source 76 and from the end 74 of the fiber optic cable 64. Collimating optics 80 reflect the radiation from the temperature source 76 via the silicon substrate 68 and the radiation from the hot cavity blackbody 56 via the pinhole 72 to the missile seeker 28. In this way, a hot, point-like target is presented against a controlled temperature background source.

Preferably, the silicon substrate 68 is super-polished for providing a spatially uniform and temporally stable reflective background surface against which to present the point-like radiation from the cavity blackbody source 56. Furthermore, the span of the fiber optic cable 20 enables the hot cavity blackbody 56 to be remotely located in spaced relation to the silicon substrate 68 for preventing localized heating of the portion presented as the background source.

In operation, each of the embodiments of the present invention provides a hot, point-like target against a given temperature background source. In one embodiment of the present invention, a space-like background source is free from heat contamination from the target radiation source since the target radiation source is remotely located from the background source through use of a fiber optic cable. In another embodiment of the present invention, a sky-like background source is provided through use of a super-polished silicon wafer which minimizes stray light noise and artifacts presented to the missile seeker detector due to surface defects. In a third embodiment of the present invention, a fiber optic cable is employed in combination with a silicon wafer to provide a thermally isolated target radiation source and a spatially uniform and temporally stable background source. Each of the embodiments of the present invention is ideal for use in remote testing of missile seekers in the field given the small number of parts required.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. An apparatus for presenting a hot, point-like target against a given temperature background for a missile seeker, said apparatus comprising:

a hot cavity blackbody target source for generating radiation in a known band;

a background source remotely located in spaced relation to said hot cavity blackbody target source; and an optical fiber operably interposed between said hot cavity blackbody target source and said background source for delivering a known bandpass of said radiation from said hot cavity blackbody target source to a location proximate said background source for simulating said hot, point-like target against said given temperature background.

2. The apparatus of claim 1 further comprising condensing optics interposed between said hot cavity blackbody target source and said optical fiber for directing said radiation into a first end of said optical fiber.

3. The apparatus of claim 1 further comprising an insulation tube encompassing said optical fiber along its length for preverting a heat signature of said optical fiber from being detected by said missile seeker.

4. The apparatus of claim 1 further comprising collimating optics disposed in radiation receiving relation to said background source and a second end of said optical fiber for delivering said radiation from said background source and from said fiber optic cable to said missile seeker to simulate said hot, point-like target against said given temperature background.

5. The apparatus of claim 4 wherein said second end of said optical fiber is positioned at a focus of said collimating optics and said background source is positioned out-of-focus relative to said collimating optic for providing a uniform background and a sharp, point-like target appearing to originate at infinity.

6. The apparatus of claim 1 wherein said background source includes a tank filled with liquid nitrogen, said tank having an aperture formed in a wall thereof for receiving said optical fiber therethrough.

7. The apparatus of claim 6 wherein said tank includes a polished and finished back surface for exhibiting high emissivity.

8. The apparatus of claim 1 wherein said background source includes a silicon wafer, said silicon wafer including a pinhole formed therethrough for emitting said radiation from said optical fiber.

9. The apparatus of claim 8 wherein said silicon substrate is gold coated.

10. The apparatus of claim 8 wherein said silicon substrate is etched to simulate a target having a known geometry.

11. The apparatus of claim 8 further comprising a controllable temperature source disposed proximate said silicon wafer for generating a controlled infrared irradiance.

12. An apparatus for simulating a hot, point-like target against a spatially uniform and temporally stable background for a missile seeker, said apparatus comprising:

a background source including a silicon substrate for providing said spatially uniform and temporally stable background;

a hot cavity blackbody target source disposed in spaced relation to said silicon substrate, said hot cavity blackbody target source generating and delivering a known bandpass of infrared radiation to a location proximate said silicon substrate for simulating said hot, point-like target; and a controllable temperature source optically communicating with said silicon substrate for providing a controllable, pre-selected irradiance for said silicon substrate to reflect.

13. The apparatus of claim 12 wherein said silicon substrate is superpolished.

14. The apparatus of claim 12 wherein said silicon substrate is gold coated.

15. The apparatus of claim 12 wherein said silicon substrate is etched to simulate a target of known geometry.

16. The apparatus of claim 12 wherein said silicon substrate includes a pinhole formed therethrough for emitting said radiator from said hot cavity blackbody target source.

17. The apparatus of claim 12 further comprising collimating optics disposed in radiation receiving relation to said silicon substrate and said hot cavity blackbody target source for delivering radiation from said silicon substrate and said hot cavity blackbody target source to said missile seeker to simulate said hot, point-like target against said given temperature background source.

18. The apparatus of claim 12 further comprising an optical fiber interposed between said hot cavity blackbody target source and said silicon substrate for delivering said known bandpass of said infrared radiation proximate said silicon substrate.

19. The apparatus of claim 18 wherein an end of said optical fiber is located adjacent a pinhole formed through said silicon substrate such that said radiation from said hot cavity blackbody target source is emitted from said pinhole.

20. The apparatus of claim 18 further comprising an insulation tube encompassing said optical fiber along its length for preventing a heat signature of said optical fiber from being detected by said missile seeker.

21. The apparatus of claim 18 further comprising condensing optics interposed between said hot cavity blackbody target source and said optical fiber for directing said radiation into a first end of said optical fiber.

22. The apparatus of claim 18 further comprising collimating optics disposed in radiation receiving relation to said silicon substrate and said optical fiber for delivering radiation from said silicon substrate and said optical fiber to said missile seeker to simulate said hot, point-like target against said given temperature background source.

23. The apparatus of claim 22 wherein said second end of said optical fiber is positioned at a focus of said collimating optics while said silicon substrate is positioned out-of-focus relative to said collimating optics for providing a uniform background and a sharp, point-like target appearing to originate at infinity.

* * * * *

UNITED STATES PATENT AND TRADEMARK OFFICE

CERTIFICATE OF CORRECTION

PATENT NO. : 6,018,163 
DATED : January 25, 2000
INVENTOR(S) : Clark A. Stephens, Jeff S. Wolske and Terry A. Sapp It is certified that error appears in the above-identified patent and that said Letters Patent is hereby corrected as shown below:

Title page,
Item [73], insert Assignee to read -- Raytheon Company, Lexington, Mass. --

Signed and Sealed this

Fourth Day of February, 2003

JAMES E. ROGAN
*Director of the United States Patent and Trademark Office*